United States Patent [19]

Scalzo et al.

[11] Patent Number: 4,523,661

[45] Date of Patent: Jun. 18, 1985

[54] EARPHONE SYSTEM FOR USE IN LARGE-CAVITY EARCUPS

[75] Inventors: John P. Scalzo; Jackson A. Aileo, both of Carbondale, Pa.

[73] Assignee: Gentex Corporation, Carbondale, Pa.

[21] Appl. No.: 494,802

[22] Filed: May 16, 1983

[51] Int. Cl.[3] ..... A42B 3/00; H04R 25/00

[52] U.S. Cl. ..... 181/129; 179/156 R; 179/182 R; 2/6

[58] Field of Search ..... 181/129, 137, 138; 179/156 R, 156 A, 180, 182 R, 182 A, 107 R; 2/6, 422, 423, 208, 209

[56] References Cited

U.S. PATENT DOCUMENTS 3,220,505 11/1965 Hargrave ..... 181/129
3,408,658 11/1968 Beguin et al. ..... 2/209
3,784,984 1/1974 Aileo ..... 2/423
3,943,572 3/1976 Aileo ..... 2/209 X
4,023,209 5/1977 Frieder, Jr. et al. ..... 2/6

*Primary Examiner*—Benjamin R. Fuller
*Attorney, Agent, or Firm*—Shenier & O'Connor

[57] ABSTRACT

A sound-attenuating earcup assembly for isolating the ear of a wearer from ambient sound while affording the wearer external communication capability without doffing the earcup assembly in which a sound-attenuating earcup of relatively rigid material forms a sound-attenuating cavity having an opening for receiving the ear of the wearer. An earphone assembly is resiliently mounted in the opening and biased outwardly of the cavity whereby the earphone assembly presses against the wearer's ear when the earcup assembly is in position on the wearer's head.

5 Claims, 11 Drawing Figures

Fig 8
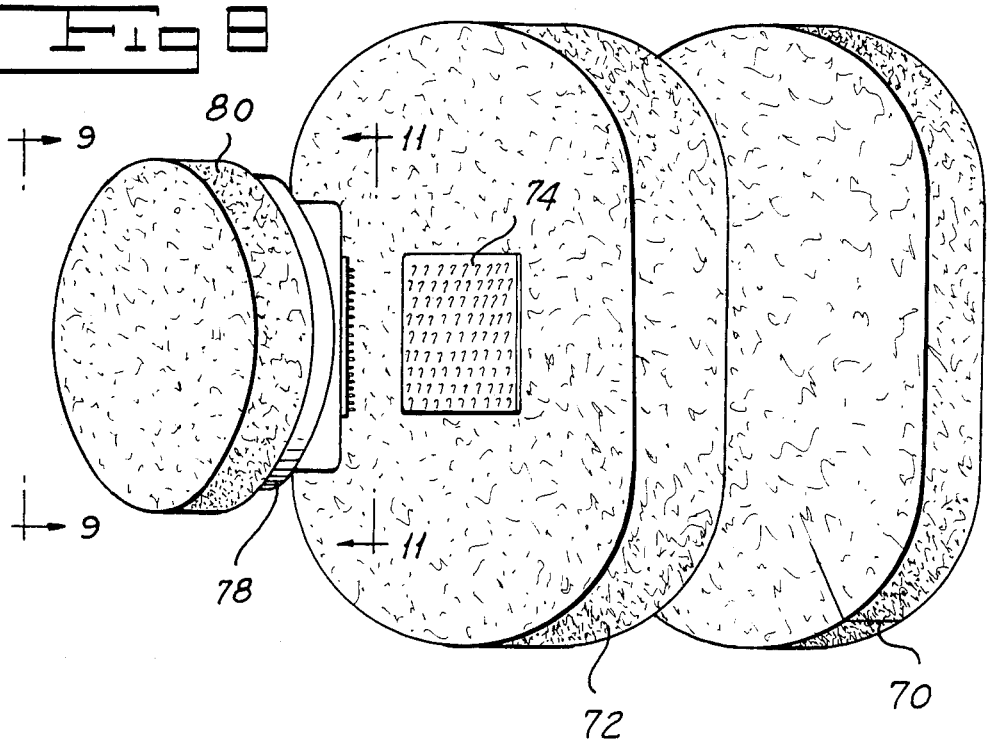
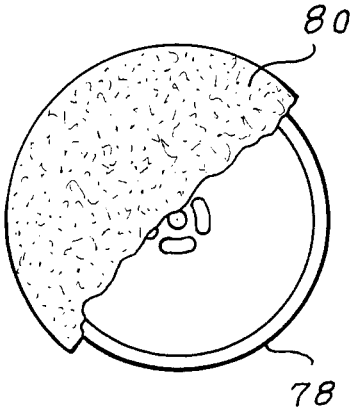
Fig 9
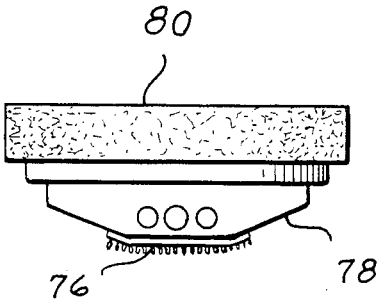
Fig 10
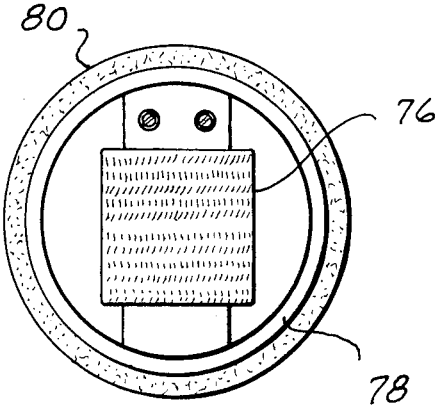
Fig 11

EARPHONE SYSTEM FOR USE IN LARGE-CAVITY EARCUPS

FIELD OF THE INVENTION

Our invention relates to earphone mounting systems and, in particular, an improved earphone mounting system for use in large-cavity earcups.

BACKGROUND OF THE INVENTION

There are known in the prior art sound-attenuating earcup assemblies which are provided with earphones which afford communication with others by way of an intercom system or the like. In such assemblies the earphone is received in a recess in an isolating pad positioned within the hard outer shell adjacent to the open end thereof. The pad is formed of foam rubber and is provided with an opening leading from the earphone to the wearer's ear. A foam pad spaces the isolating pad from a cover assembled over a switch housing formed in the wall of the cup. A sound-attenuating earcup of the type just described is shown, for example, in Frieder, Jr. et al U.S. Pat. No. 4,023,209, issued May 17, 1977.

Assemblies of the type described above typically require earcups which enclose an appreciable volume of air. For example, helmets used by military combat vehicle crewmen require large-cavity earcups to provide adequate sound attenuation and ear protection. However, attempts to mount earphones in large-cavity earcups using an arrangement such as that shown in the Frieder et al patent have not proved satisfactory. With such an arrangement it has been found that the large-cavity earcup adversely affects the operation of the earphones. This is due to the fact that most earphones are designed to provide a satisfactory response in a 6 cc coupler and, therefore, when they are installed in a large volume earcup (over 100 cc) the response deteriorates at lower frequencies, severely affecting intelligibility in communication. In addition, systems of the prior art do not permit close coupling of the earphone to the ear without discomfort.

SUMMARY OF THE INVENTION

One object of our invention is to provide an improved earphone mounting system for use in large-cavity earcups which improves the noise-attenuating and intelligibility properties of the earphone.

Another object of our invention is to provide an improved earphone mounting system for use in large-cavity earcups in which the response obtained from the earphones does not deteriorate at lower frequencies.

Still another object of our invention is to provide an improved earphone mounting system for use in large-cavity earcups which permits slight movement of the earphones relative to the ears to avoid discomfort while preventing excessive movement of the earphones during normal use.

A further object of our invention is to provide an improved earphone mounting system for use in large-cavity earcups which creates small-volume cavities between the earphones and the user's ears.

A still further object of our invention is to provide an improved earphone mounting system for use in large-cavity earcups which allows the earphones to automatically couple closely to the user's ears without discomfort.

Other and further objects of our invention will appear from the following description.

In general, our invention contemplates an earcup assembly in which an earcup of relatively rigid material is formed with a cavity for receiving the ear of a wearer and in which an earphone receivable in the cavity is resiliently biased outwardly of the cavity into engagement with the ear of the wearer. Preferably, the earphone carries a resilient cushion for engaging the ear of the wearer under the action of the biasing means, while the biasing means comprises a resilient pad disposed in the earcup cavity, to which the earphone is secured.

BRIEF DESCRIPTION OF THE DRAWINGS

In the accompanying drawings to which reference is made in the instant specification and which are to be read in conjunction therewith, and in which like reference numerals are used to indicate like parts in the various views:

FIG. 8 is an exploded view of an alternative embodiment of an earphone mounting system for use in a large-cavity earcup.

FIG. 9 is an elevation of the earphone assembly of the system shown in FIG. 8 as viewed along line 9—9, with parts broken away.

FIG. 10 is a top plan of the earphone assembly of the system shown in FIG. 8.

FIG. 11 is an elevation of the earphone assembly of the system shown in FIG. 8 as viewed along line 11—11.

DESCRIPTION OF THE PREFERRED EMBODIMENTS

Figure 1:
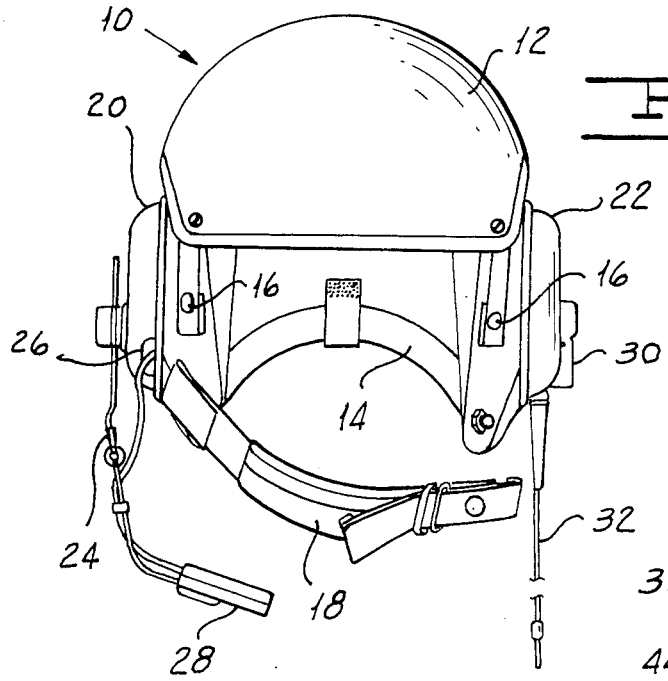
FIG. 1 is a front elevation of a military combat vehicle crewman's helmet having large-cavity earcups with which our improved earphone mounting system is used.

Referring now to FIG. 1, a military combat vehicle crewman's helmet indicated generally by the reference character 10, which employs large-cavity earcups with which our improved earphone mounting system may be used, includes a rigid outer shell 12, an inner liner 14 and a communications system to be described. The outer shell 12, formed from any suitable material such as high-strength fiberglass-cloth-reinforced epoxy, is attached to the inner liner 14 by snap fasteners 16 at the temple and back and by Velcro tape, not shown, in the crown. This permits removal of the liner 14 for cleaning and parts servicing. A chin strap 18 is provided to hold the helmet on the wearer's head. Since the details of the construction of the helmet 10, with the exception of the earphone mounting system, do not form part of our invention they will not be described in detail. A helmet of this type is shown in Aileo U.S. Pat. No. 3,784,984.

The inner liner 14, which is formed from any suitable material such for example as flexible energy-absorbing pads enclosed in a nylon mesh fabric, supports a pair of large-cavity earcup assemblies 20 and 22, adapted to provide sound attenuation and ear protection to the wearer. The earcup assemblies, which support a pair of earphones in a manner to be more fully described hereinbelow, form the basis of the helmet communication system. Earcup 20 is provided with means to support a microphone boom 24 and with a socket 26 into which a plug from the microphone 28 may be inserted, coupling it to the system in a manner known to the art. Earcup 22 is provided with a switch 30 and an external lead 32 adapted to connect the helmet's system to a vehicle communications system.

Figure 2:
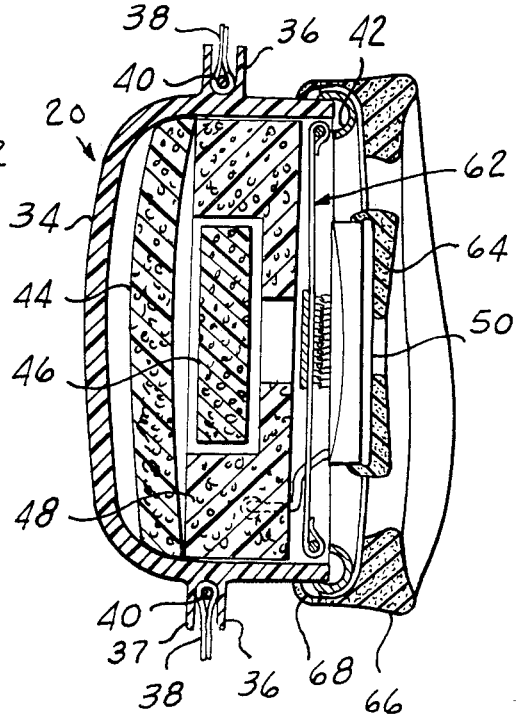
FIG. 2 is a vertical section of a large-cavity earcup and earphone assembly incorporating one embodiment of our improved mounting system.
Figure 4:
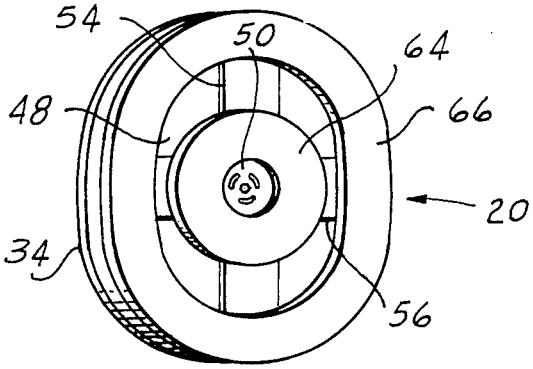
FIG. 4 is a perspective view from the side of the wearer's ear of the assembly shown in FIG. 2.
Figure 3:
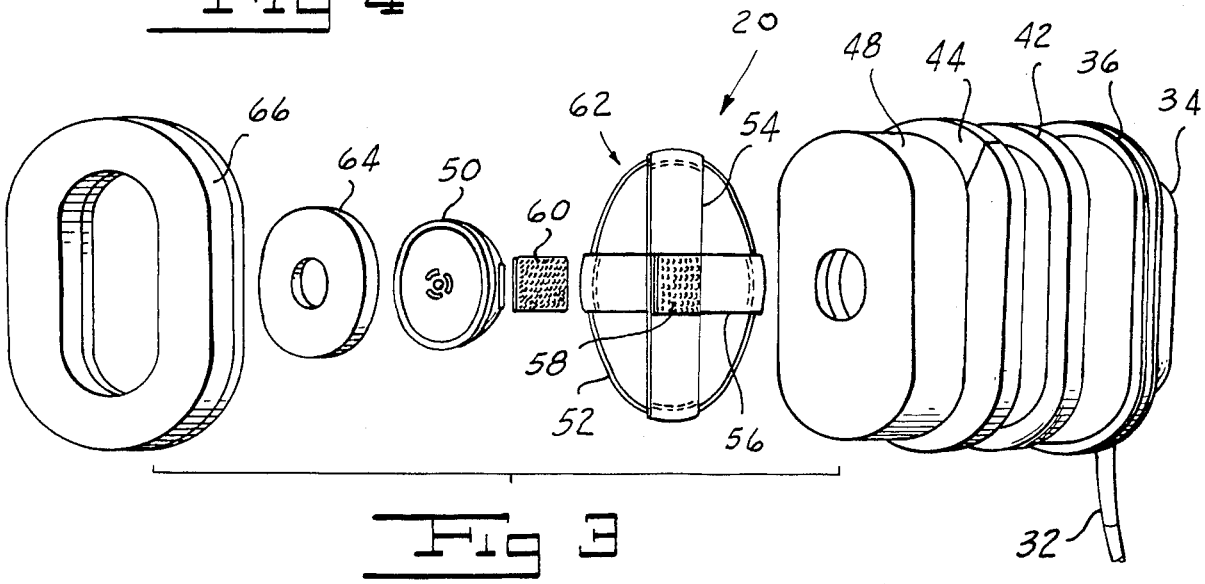
FIG. 3 is an exploded view of the assembly shown in FIG. 2.

Since the earphone supporting systems of both of the assemblies 20 and 22 are the same, only that of assembly 20 will be described in detail. Referring now to FIGS. 2, 3, and 4, the earcup assembly 20 comprises a rigid cup-shaped shell 34 formed from any suitable material, such for example as a suitable synthetic resin, and provided with a pair of outwardly extending spaced flanges 36 and 37. Flanges 36 and 37 extend peripherally around the shell 34 and define a channel for receiving a fabric loop 38 which surrounds an opening in the liner 14. A cord 40 disposed in the loop 38 is adapted to be tightened to hold the liner 14 in engagement with the outer surface of the earcup shell 34, in a manner known to the art.

The open end of the shell 34 is provided with an inwardly directed flange 42, which can be an integral part of the shell or a separate element attached to the rim by any suitable means, such for example as bonding. The flange 42 is generally semi-circular in cross-section and is contoured to conform to the head of the wearer, following the average bumps and hollows of a human head along a path encircling the ear. We have shown a large-cavity shell 34 which does not have a switch housing formed in the wall thereof.

Our earphone mounting system utilizes the standard shell 34 together with an earcup filler pad 44, made of foam rubber or the like, positioned furthest from the wearer's ear. Two earcup pad inserts 46 and 48, between which the earphone 50 was formerly disposed, are positioned next to pad 44. It will be readily appreciated that while we have used pads 44, 46, and 48 to permit an inexpensive and simple retrofit, in an original manufacturing operation the three separate pads could be replaced by one.

Our earcup mounting arrangement includes a stainless resilient wire ring 52. We fold the ends of a pair of elastic straps 54 and 56 over ring 52 and stitch them to the straps. The straps are suspended across the ring in a cross pattern, forming a square of overlapping fabric at the approximate center of the oval ring, at which point the straps are sewn to each other. Over this square of overlapping fabric we stitch one part 58 of a two-part fastener, such for example as a square piece of "Velcro" hook fabric, manufactured by Velcro USA Inc. under the trademark "VELCRO". The other part 60 of the fastener, which may for example be a square piece of "Velcro" pile fabric, is glued to the back portion of the earphone 50. This ring assembly, indicated generally by the reference character 62, is easily snapped into the earcup shell 34 behind flange 42 and on top of foam insert 48. It will be readily appreciated that flange 42, defining a smaller opening than that of shell 34, serves to retain the ring assembly 62 within the shell 34.

We detachably connect the earphone 50 to the ring assembly 62 by mating fasteners 58 and 60. Earphone 50 is provided with an earphone cushion 64 which fits over the front of the earphone and serves to couple the earphone to the ear as will be more fully described hereinbelow. Cushion 64 is formed from material that closely resembles human skin in texture so as to minimize discomfort to the wearer. It will be readily appreciated that the ring assembly 62 serves to position the earphone 50 in the approximate center of the elliptically shaped open end of the earcup shell 34. Before being brought into engagement with the wearer's ear, the assembly of the earphone 50 and the cushion 64 extends outwardly beyond flange 42.

The final step in either the original manufacture or retrofit procedure is to secure a doughnut-shaped earseal 66 to the shell 34. Earseal 66 is formed with an internal diameter somewhat greater than the diameter of the earphone 50 together with the cushion 64, giving it a smaller face than that of the earseal presently employed, which would otherwise obstruct the earphone 50 in its new position. Earseal 66 is formed from a resilient sealing pad elliptically annular in shape which rests on flange 42, encircling the ear of the wearer and engaging that portion of the wearer's head surrounding the ear. In addition, it is provided with a flap 68 which overlies the outer edge of the flange 42 and outer rim of the shell 34, sealing the pad against the shell and flange. This smaller earseal permits the cushioned earphone 50 to extend outwardly through the elliptical opening in the shell 34 beyond flange 42, to a position at which its outer edge is almost flush with the plane formed by the outer edge of the earseal 66.

It will be readily appreciated that when the helmet 10 is put on by the wearer, the earcup assemblies 20 and 22 are pulled over the ears and immediately the earphone cushions 64 are in contact with the ears of the wearer. As the chin strap 18 is tightened, the earseals 66 come into contact with the portion of the head of the wearer surrounding the ears, completely enclosing them and providing a relatively soundproof seal, while the cushioned earphones 50 are moved inwardly into the shells 34 by the wearer's ears. The foam pads 44, 46 and 48, together with the elastic straps 54 and 56, serve to permit a certain amount of inward movement of the earphones 50 while keeping them firmly coupled to the wearer's ears without discomfort, forming an acoustical seal therewith and creating small-volume cavities between the earphones and the wearer's ears.

Figure 5:
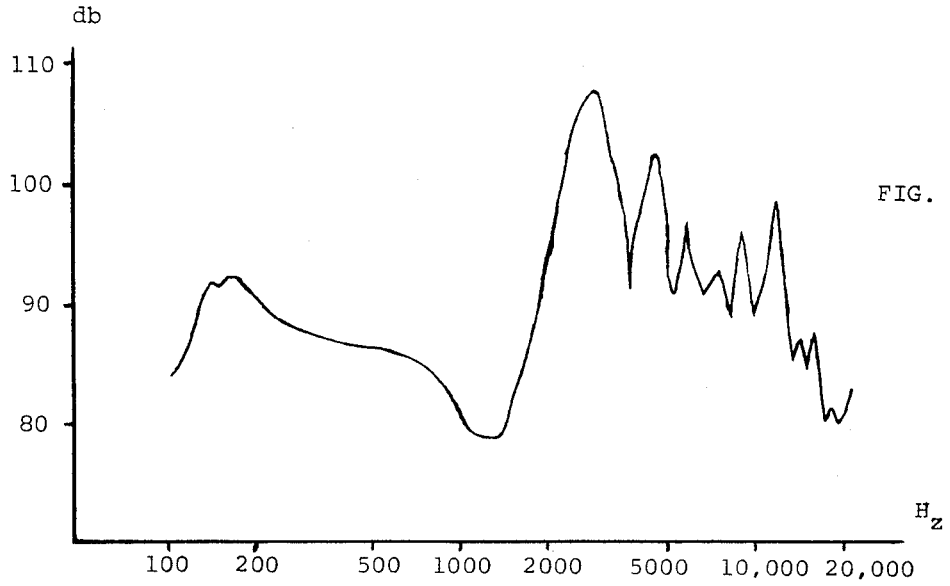
FIG. 5 is a graph illustrating the frequency response obtained when using an earphone mounting system of the prior art in a large-cavity earcup.
Figure 6:
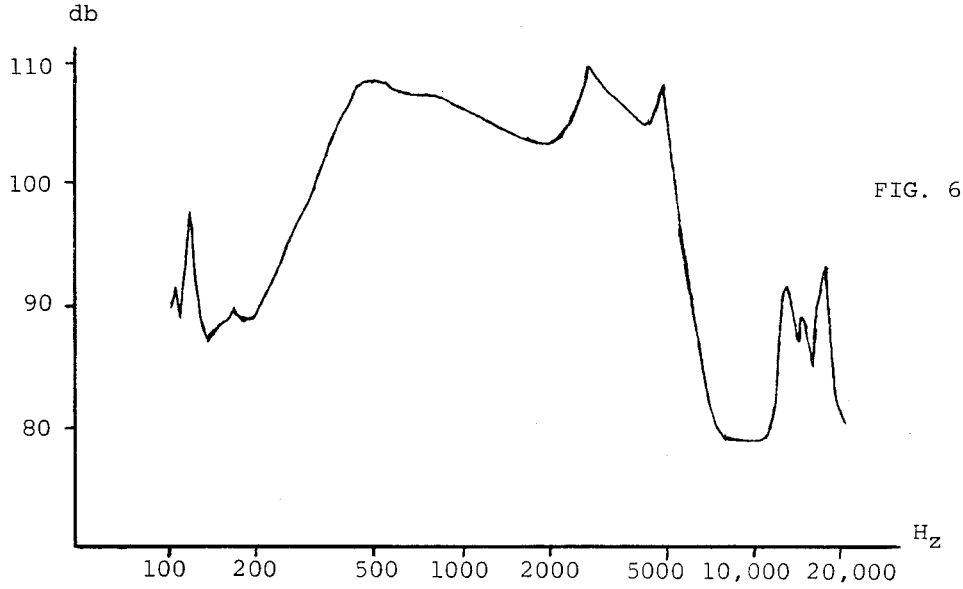
FIG. 6 is a graph illustrating the frequency response obtained when using the assembly shown in FIG. 2.
Figure 7:
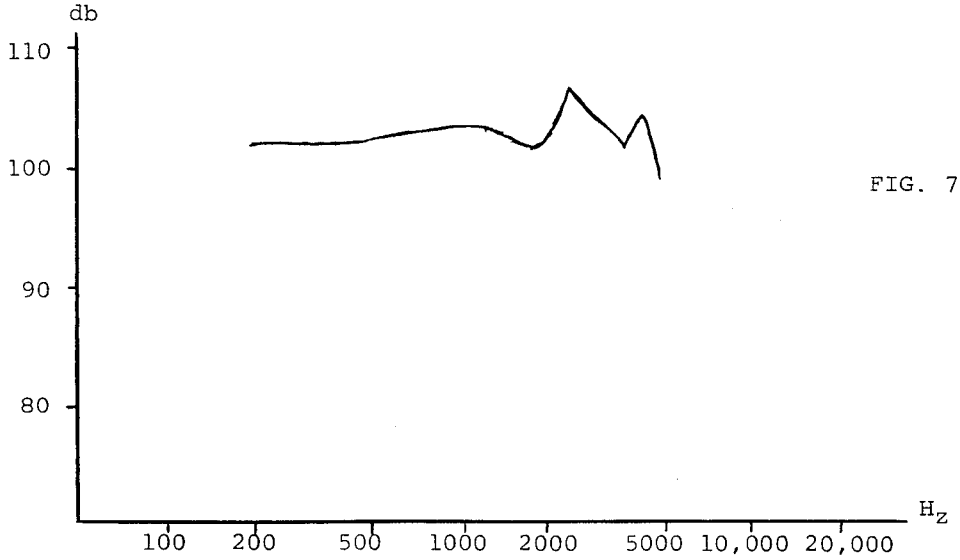
FIG. 7 is a graph illustrating the frequency response obtained from an earphone in a 6 cc coupler.

Referring now to FIGS. 5, 6, and 7, we have shown, respectively, the frequency response obtained when the earphone is used in a large-cavity earcup without our improved mounting system, the frequency response obtained with our improved earphone mounting system, and the near-linear frequency response obtained when the earphone is mounted in a 6 cc coupler. Each of the figures shows the relationship of the sound pressure in decibels (db) with 1 milliwatt applied power to the frequency in cycles per second or Hertz (Hz), using a pressure reference of 0.0002 dyne/cm$^2$, or 20 $\mu$Pa. (Standard atmospheric pressure is $1.013\times10^5$ Pa.) It will be readily appreciated that the near-linear frequency response obtained by the use of the 6cc coupler is desirable over that obtained by use of earphone mounting systems of the prior art, in which the response suffers at the lower end of the spectrum. In addition, it will be seen that the frequency response obtained by use of our improved mounting system closely resembles the performance of the earphone as it would be if installed in a 6 cc coupler.

Referring now to FIGS. 8 to 11, we show a preferred form of earphone mounting system for a right earcup; for a left earcup, the construction shown in FIGS. 8 to 11 is simply reversed. The system replaces elements 44 to 64 of the embodiment shown in FIGS. 2 to 4. In this alternative system, a first earcup filler pad 70, similar to pad 44, is adapted to be positioned within a large-cavity earcup shell, such as the shell 34 shown in FIGS. 2 to 4, at a location inside the shell remote from the wearer's ear. A second earcup filler pad 72, similar to pad 48 but imperforate, is then inserted in the earcup shell. Both pads 70 and 72 may be formed from any suitable resilient material such as polyurethane foam or the like.

We secure, using any suitable adhesive, one part 74 of a two-part fastener, such as a square strip of "Velcro" hook fabric, to pad 72 at the approximate center of the surface thereof nearest the wearer's ear. The other part 76 of the fastener, which may be a complementary strip of "Velcro" pile fabric, is secured with a suitable adhesive to the back portion of an earphone 78 similar to earphone 50. We detachably secure the earphone 78 to the pad 72 with mating fasteners 74 and 76. An earseal such as the earseal 66 shown in FIGS. 2 to 4 is then secured to the shell. Earphone 78 is also provided with an earphone cushion 80 formed of a suitable acoustically transparent synthetic foam, which is secured to the front of the earphone with an adhesive and which is maintained in pressing contact with the wearer's ear.

It will readily be appreciated that once the earcup is positioned over the ear of the wearer, pads 70 and 72 serve to maintain pad 80 of earphone 78 in pressing contact with the wearer's ear, thereby keeping the earphone 78 firmly coupled to the wearer's ear without discomfort. Since intermediate pad 72, unlike pad 48, is imperforate, we are able to dispense with the ring assembly 62 comprising the wire ring 52 and straps 54 and 56, greatly simplifying the overall structure.

It will be seen that we have accomplished the objects of our invention. We have provided an improved earphone mounting system for use in large-cavity earcups which improves the noise-attenuating and intelligibility properties of the earphone. In our system the response obtained from the earphones does not deteriorate at lower frequencies. Our system permits slight movement of the earphones to avoid discomfort while preventing excessive movement of the earphones during normal use. Our improved mounting system allows the earphones to automatically couple closely to the user's ears without discomfort, creating small-volume cavities between the earphones and the user's ears.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. An earcup assembly including in combination an earcup of relatively rigid material forming a cavity for receiving the ear of a wearer, an earphone receivable in said cavity, and means for resiliently biasing said earphone outwardly of said cavity into engagement with the ear of the wearer, said biasing means comprising an elastic strap suspended across the opening of said cavity and means for securing said earphone to said strap.

2. Apparatus as in claim 1, said biasing means further comprising a frame, said elastic strap being suspended across said frame, and means for retaining said frame within said earcup adjacent to the periphery thereof.

3. Apparatus as in claim 1 in which said elastic strap is a first strap, said biasing means further comprising a second elastic strap intersecting said first strap, a resilient loop carrying said straps, and means extending inwardly from the periphery of said cavity for retaining said loop in said cavity.

4. An earcup assembly including in combination an earcup of relatively rigid material forming a cavity for receiving the ear of a wearer, an earphone receivable in said cavity, and means for resiliently biasing said earphone outwardly of said cavity into engagement with the ear of the wearer, said biasing means comprising a resilient support disposed in said cavity, a strip of hook fastener material secured to one of said support and said earphone, and a strip of loop fastener material secured to the other of said support and said earphone.

5. An earcup assembly including in combination an earcup or relatively rigid material forming a cavity for receiving the ear of a wearer, an earphone receivable in said cavity, a first elastic strap suspended across the opening of said cavity, means for securing said earphone to said strap, a second elastic strap intersecting said first strap, a resilient loop carrying said straps, and means extending inwardly from the periphery of said cavity for retaining said loop in said cavity.

* * * * *